US007810184B2

(12) United States Patent
McCollum

(10) Patent No.: US 7,810,184 B2
(45) Date of Patent: Oct. 12, 2010

(54) FITTED SHEET SYSTEM

(76) Inventor: Kathleen McCollum, The Home Office, James Store, VA (US) 23128-9013

( * ) Notice: Subject to any disclaimer, the term of this patent is extended or adjusted under 35 U.S.C. 154(b) by 0 days.

(21) Appl. No.: 12/230,022

(22) Filed: Aug. 21, 2008

(65) Prior Publication Data

US 2010/0043145 A1 Feb. 25, 2010

(51) Int. Cl.
*A47C 31/00* (2006.01)

(52) U.S. Cl. ..... 5/500; 5/482; 5/485; 5/495; 5/497; 5/499

(58) Field of Classification Search ..... 5/482, 5/485, 488, 495–500, 503; D6/595, 596, D6/601, 602
See application file for complete search history.

(56) References Cited

U.S. PATENT DOCUMENTS

| | | | | |
|---|---|---|---|---|
| 801,279 | A * | 10/1905 | Slyke | 5/499 |
| 1,269,276 | A * | 6/1918 | Harris | 383/4 |
| 2,385,067 | A * | 9/1945 | Egardner | 5/627 |
| 2,598,141 | A * | 5/1952 | Simpson | 5/497 |
| 3,321,782 | A * | 5/1967 | Hrubecky et al. | 5/487 |
| 3,514,796 | A * | 6/1970 | Dibrell | 5/485 |
| 4,021,869 | A | 5/1977 | Root | |
| 4,237,805 | A | 12/1980 | Ferrante et al. | |
| 4,384,380 | A | 5/1983 | Glaha et al. | |
| 4,658,454 | A | 4/1987 | Potter | |
| 4,924,543 | A * | 5/1990 | Hoss et al. | 5/484 |
| 4,980,941 | A | 1/1991 | Johnson, III | |
| 5,153,957 | A | 10/1992 | Price, Sr. | |
| 5,173,976 | A | 12/1992 | Jubinville | |
| 5,177,821 | A | 1/1993 | Kawtoski | |
| 5,438,719 | A | 8/1995 | Anthony | |
| 5,513,403 | A | 5/1996 | Wooten, Jr. | |
| 5,732,424 | A * | 3/1998 | Bond | 5/502 |
| 5,809,593 | A | 9/1998 | Edwards | |
| 5,901,389 | A | 5/1999 | Manner | |
| 6,161,235 | A * | 12/2000 | Smith et al. | 5/504.1 |
| 6,601,250 | B1 * | 8/2003 | Taylor | 5/485 |
| D479,937 | S * | 9/2003 | Harrelson | D6/601 |
| 6,631,528 | B2 | 10/2003 | Landry | |
| 6,857,146 | B2 | 2/2005 | Landry | |
| 7,086,102 | B1 * | 8/2006 | Frazier | 5/502 |
| 7,316,039 | B2 | 1/2008 | Wootten, Jr. | |
| 2003/0037374 | A1 | 2/2003 | Ciaglia et al. | |
| 2007/0214569 | A1 | 9/2007 | Miller | |
| 2007/0271699 | A1 | 11/2007 | Sacchetti | |

FOREIGN PATENT DOCUMENTS

| | | |
|---|---|---|
| GB | 933420 | 8/1963 |
| GB | 1012503 | 12/1965 |

* cited by examiner

*Primary Examiner*—Robert G Santos
*Assistant Examiner*—Nicholas Polito
(74) *Attorney, Agent, or Firm*—Richard C. Litman

(57) ABSTRACT

The fitted sheet system is adapted for ship bunk systems and comprises either a single flat sheet or two single sheets sewn together. The sheet includes two opposed top ends and two opposed sides. The opposed ends include hospital corners to provide a tight fit. The top sheet is sewn along a side edge of the bottom sheet and is adapted to fold over the mattress top. Four equally spaced matching slots, two on each longitudinal side, are disposed on the bottom edges of the two sides for receiving straps. Alternatively, straps are provided at the bottom of the sheet for tightening the sheet over the mattress. A pillowcase is attached to the sheet. A decorative hem displaying a logo is disposed on the fitted sheet.

9 Claims, 7 Drawing Sheets

FITTED SHEET SYSTEM

BACKGROUND OF THE INVENTION

1. Field of the Invention

The present invention relates to a fitted sheets combination including a top sheet and a bottom sheet for fitting over a mattress.

2. Description of the Related Art

Fitted bottom sheets are known including an overhang which overhangs the sides of a mattress and is drawn inwardly under the mattress by elastic strips so that the bottom sheet is tightly spread over the top of the mattress and held securely in place. When a separate flat top sheet is used with the fitted bottom sheet, it must be carefully adjusted and tucked in with hospital corners, and even then the top sheet comes untucked readily. This makes making up the bed an unnecessarily complicated procedure for everyone, and a potentially difficult procedure for those with vision problems or other physical difficulties.

Fitted top sheets are also known having the same type of fitting at the bottom as the fitted bottom sheets, but this construction leaves little room at the bottom for the sleeper's feet.

It is even known to have a combination of a fitted bottom sheet with an attached top sheet. However, the known constructions for such combinations either provide too little space for the sleeper's feet and/or require complicated constructions that are relatively expensive and difficult to handle when making up the bed. Moreover, problems continually arise when users try to accommodate bunk beds, shipboard beds, or the like with existing, known fitted sheets. The existing fitted sheets are not designed to neatly fit a bunk bed, especially one that has one longitudinal edge abutting a wall, as is often the case aboard a ship, submarine, or similar environment.

Thus, a fitted sheet system solving the aforementioned problems is desired.

SUMMARY OF THE INVENTION

The fitted sheet system is adapted for cots, portable mattresses, ship bunk systems, or the like, and comprises either a single flat sheet or two single sheets sewn together. The sheets include two opposed top ends and two opposed sides. The opposed ends include hospital corners to provide a tight fit. The top sheet is sewn along a side edge of the bottom sheet and is adapted to fold over the mattress top. Straps are provided at the bottom of the sheet for tightening the sheet over the mattress.

Alternatively, four equally spaced matching slots, two on each longitudinal side, are disposed on the bottom edges of the two sides for receiving straps. A pillowcase is attached to the sheet. A decorative hem displaying a logo is disposed on the fitted sheet.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
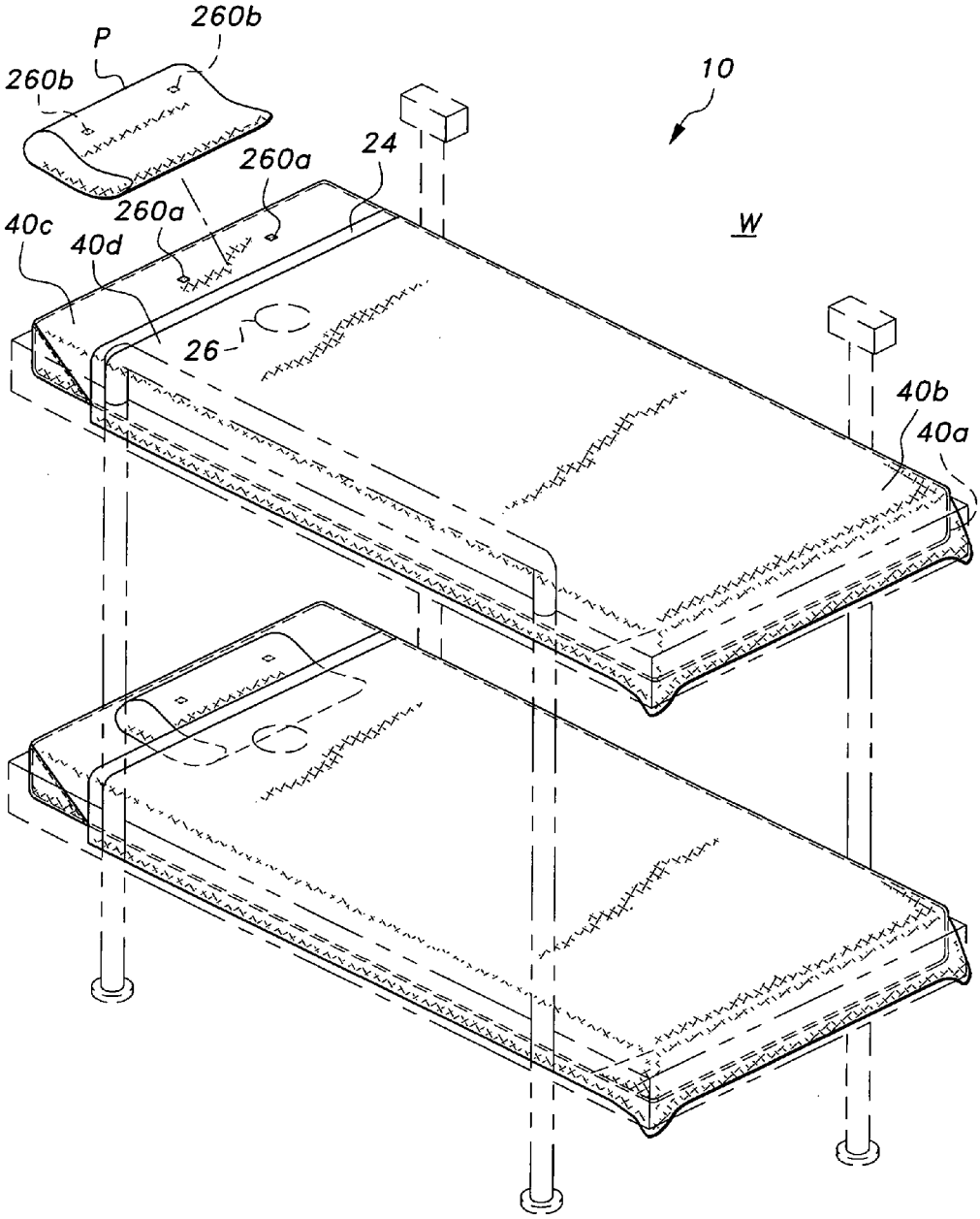
FIG. 1 is an environmental, perspective view of a fitted sheet system according to the present invention.
Figure 2:
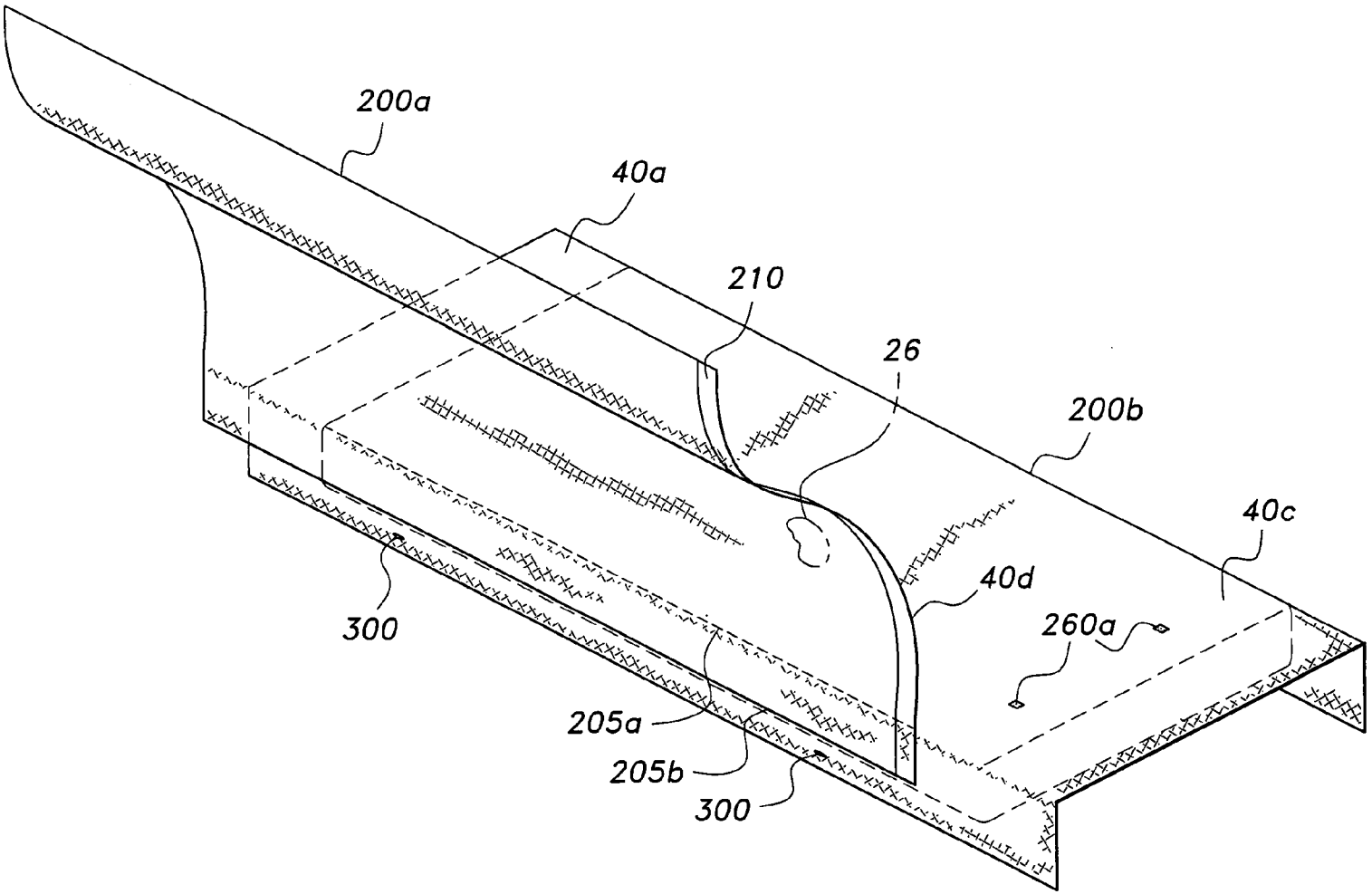
FIG. 2 is a perspective view from the bunk-side of the fitted sheet system according to the present invention.
Figure 3:
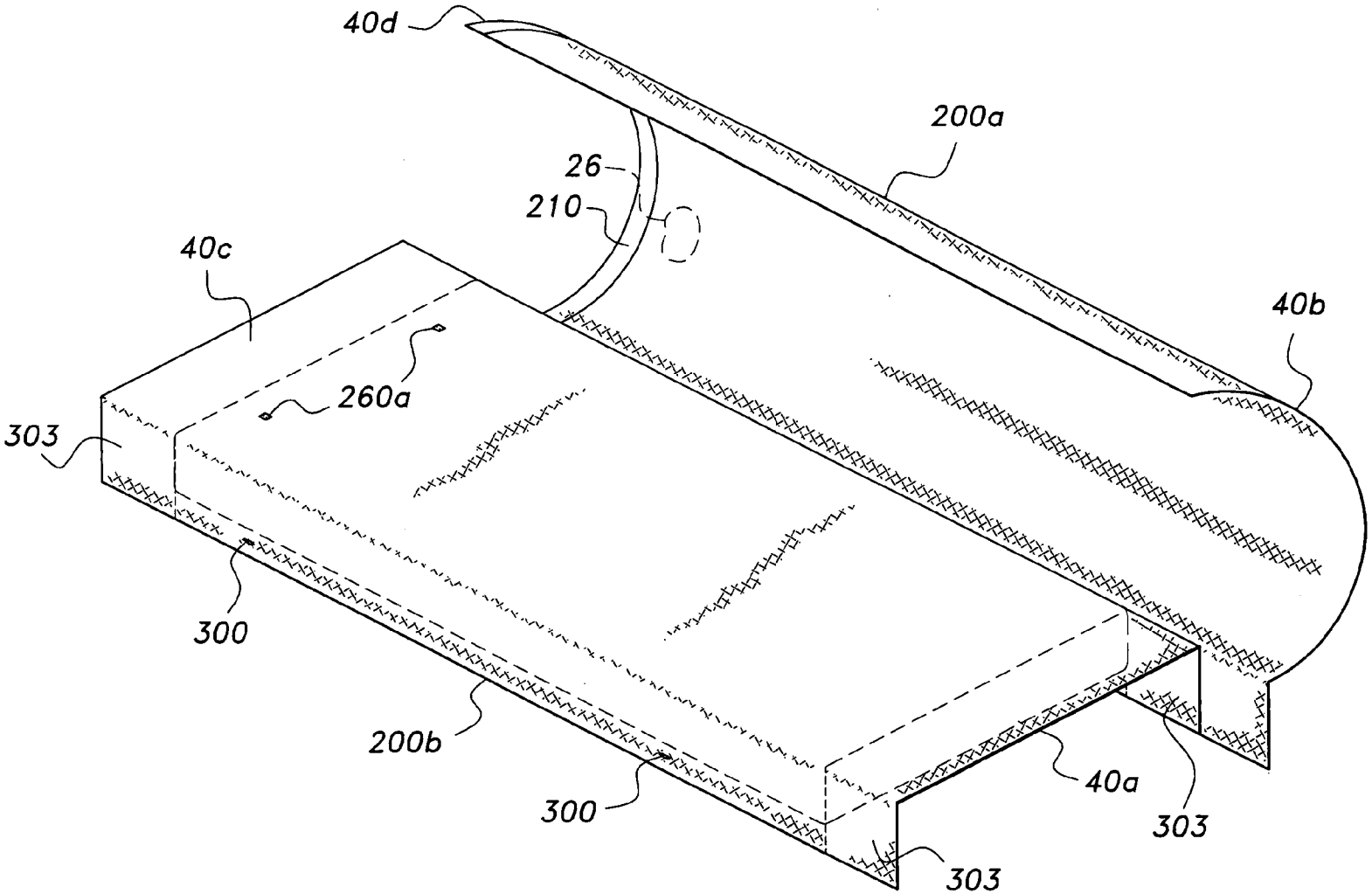
FIG. 3 is a perspective view from the open side of the fitted sheet system, according to the present invention.
Figure 4:
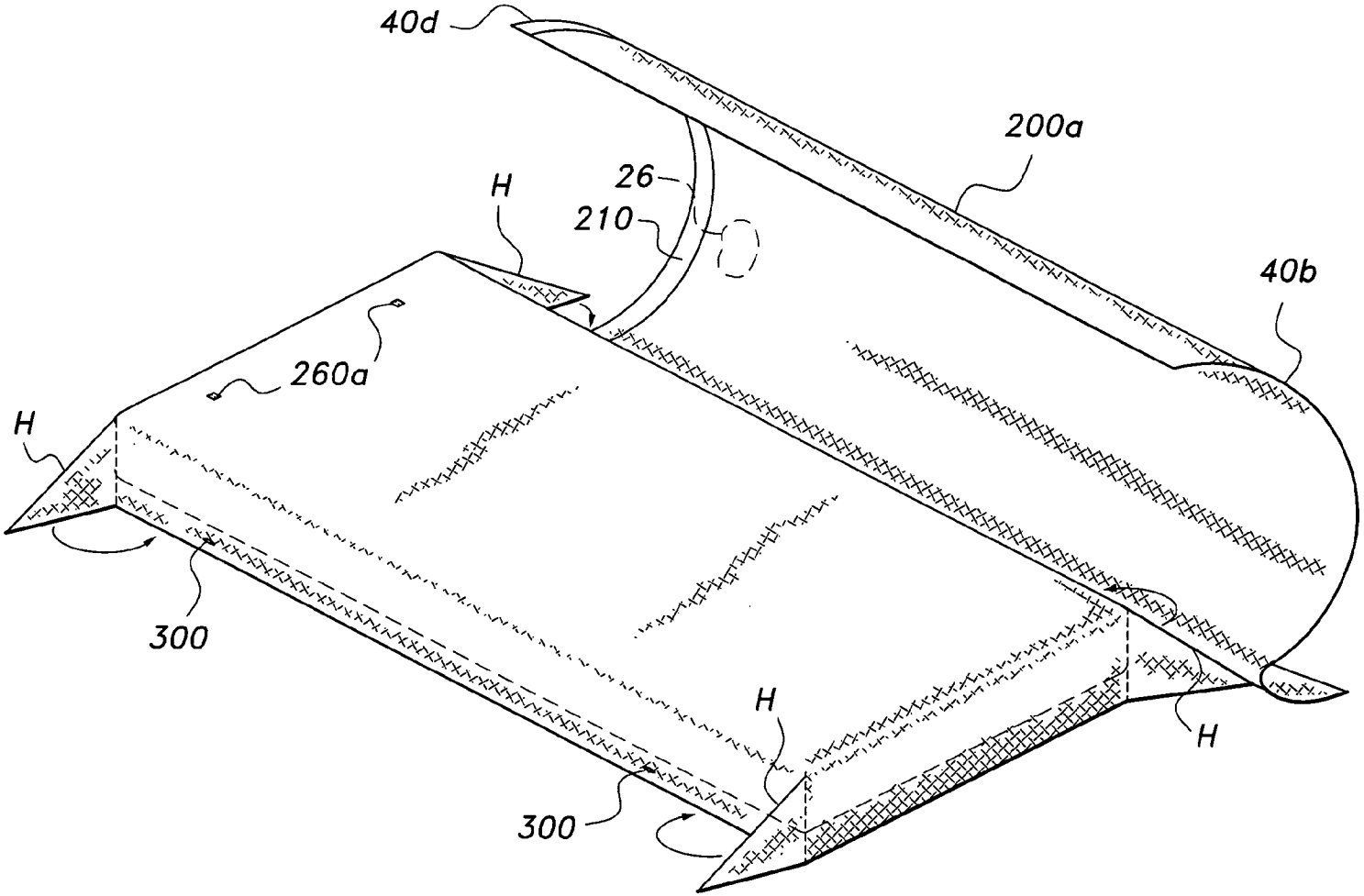
FIG. 4 is a perspective view of the fitted sheet system showing the corner folds, according to the present invention.
Figure 5:
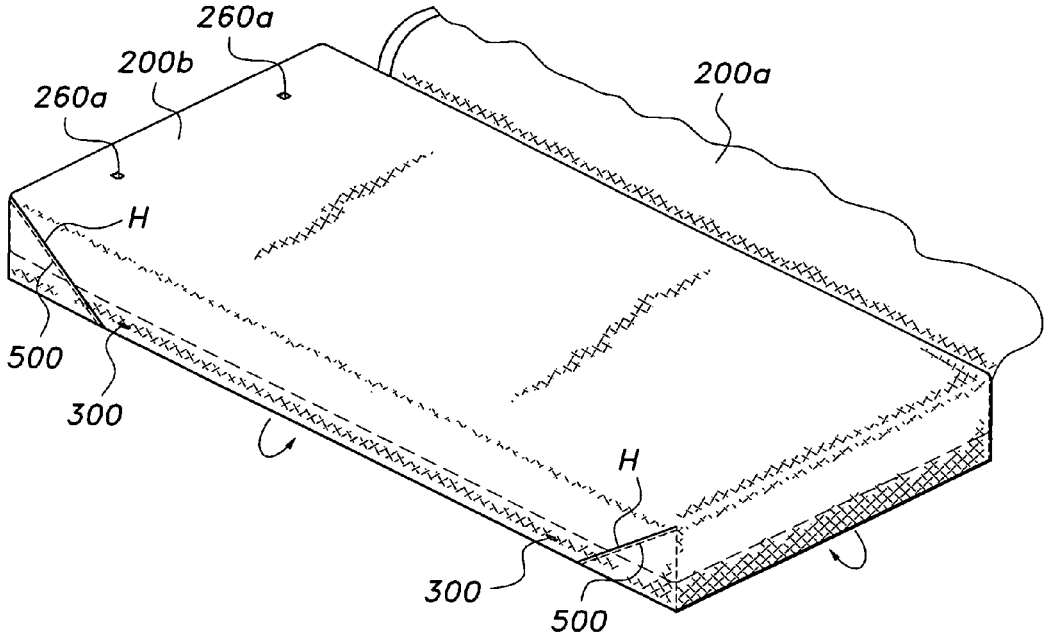
FIG. 5 is a perspective view of the fitted sheet system showing the corner folds sewn in place, according to the present invention.
Figure 6:
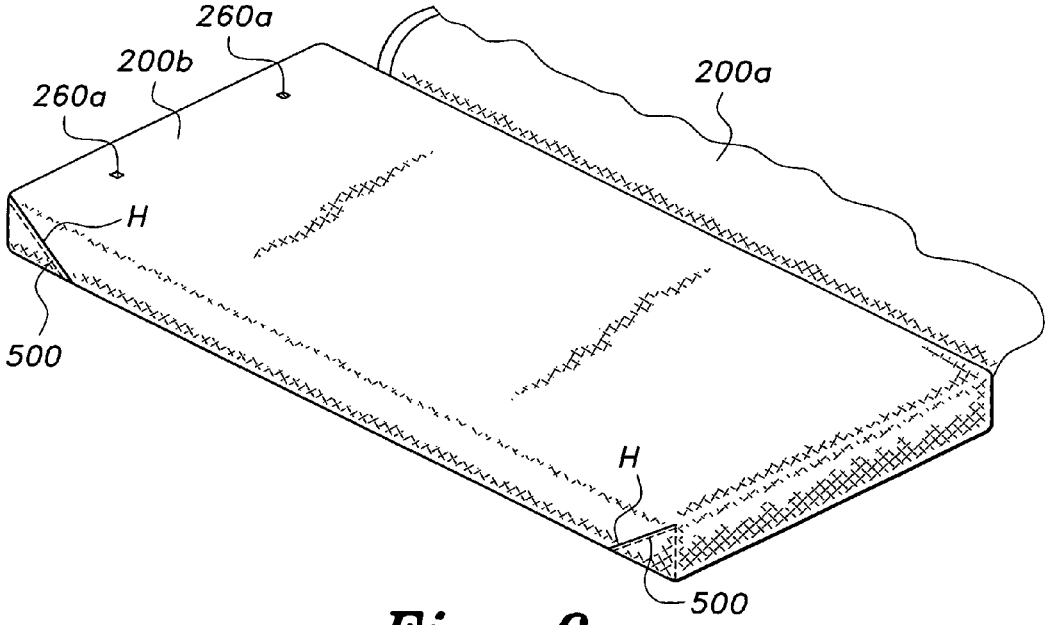
FIG. 6 is a perspective view of the fitted sheet system showing the excess upper sheet being tucked in, according to the present invention.

As shown in FIGS. 1-8, the present invention, a fitted sheet system 10, is adapted primarily for ship bunk systems attached to a wall W and comprises either a single flat sheet or two single sheets sewn together. The fitted sheet system 10 has a bottom portion laterally extending foot area 40*a* a top portion laterally extending foot area 40*b*, a bottom portion laterally extending head area 40*c* and a top portion laterally extending head area 40*d*. The fitted sheet system 10 is viable for use on shipboard beds of all types and sizes. It can also be used for army style cots whether the mattress is a foam pad, air mattress, or sleeping bag. It can cover any type of mattress or pad utilized in recreational vehicles, typical mattresses found for use in homes, rehabilitation and medical facilities, camping, and aboard aircraft.

The fitted sheet system 10 will be made specifically to fit the different dimensions of mattresses that are in use in all different vehicle size configurations. The top sheet 200*a* is attached to the bottom sheet 200*b* by way of an upper longitudinal seam 205*a* and a lower longitudinal seam 205*b*. The pocket created by the two seams 205*a* and 205*b* can be used to store a pillowcase P. The top sheet 200*a* is initially folded over and sewn down at the head end of the top sheet to accommodate the application of a shipboard design, logo 26, or the like, to identify group affiliation, identity, or the like, on or proximate the wide hem 24.

The folded down portion presents the always neat appearance of a perfectly made bed. The lower seam 205*b* attaches the top sheet 200*a* to the bottom sheet 200*b*, the lower seam 205*b* being removably placed along the bottom edge of a mattress, approximately 8 inches from a head corner seam (to accommodate a folded down head portion) all the way to a foot corner seam, and the second seam 205*a* is removably placed along the top edge of the mattress.

The foot end 40*b* of the sheet 200*a* remains unhindered by seams but can be left tucked under the mattress when in use. The bottom sheet 200*b* (fitted via straps 405*a*, 405*b* or alternatively straps 705*a* and 705*b*) is folded and sewn in such a manner that it has ready-made hospital corners, the hospital corners being created by a vertical stitch line and folded up excess corner material of the sheet. The hospital corners may be elastic and can be sewn into the corners on the underside of the sheet to help the sheet fit all sizes of mattress. Both front edge and back edge of the bottom sheet (on the underside) can have reinforced slots 300 sewn in where optional straps, such as diagonal cross straps 405*a* and 405*b*, or parallel straps 705*a* and 705*b*, which may be elastic with snaps, or cloth ties, can be applied to keep the sheets 200*a*, 200*b* pulled tightly to fit snugly on a mattress. This option is preferably offered for military shipboard use where mattresses are smaller and easier to lift for application.

The hospital corners H of the bottom sheet have right angles secured by sewing line 500 to present the always neat appearance of a perfectly made bed. The right angle appearance is formed by tucking in and sewing excess corner material 303. The hospital corners H are sewn to present as right angle folds that are the same inside and outside of the sheet 200*b* in order to make it fully reversible to accommodate placing the head of the mattress on either the left or right end of the bed as viewed from the open side of the bed where it's being made. The top sheet 200*a* has a decorative hem 210 created by a stitching 24 at the pillow end, which may be folded and sewn down. The center of this panel and the center of the pillowcase are designated areas for embroidery logos of prospective buyers, or the like. The top sheet can have two of the slots 300 placed on the open edge to fasten the top sheet 200*a* snugly to the straps for tightness and security on a military ship.

The pillow case P can either be sewn on both upper corners to the bottom sheet 200*b* or hook and loop tabs 260*b* can be sewn onto both upper corners of the pillow case P with matching complementary hook and loop tabs 260*a* sewn on the upper edge of the bottom fitted sheet to provide for uniform placement of the pillow case P.

The fitted sheet system 10 of the present invention will be made separately ready for left or right head of the mattress accessibility, but can be switched by turning the bottom sheet inside out and flipping the top sheet over with only the loss of decoration (when used) in those instances.

Figure 7:
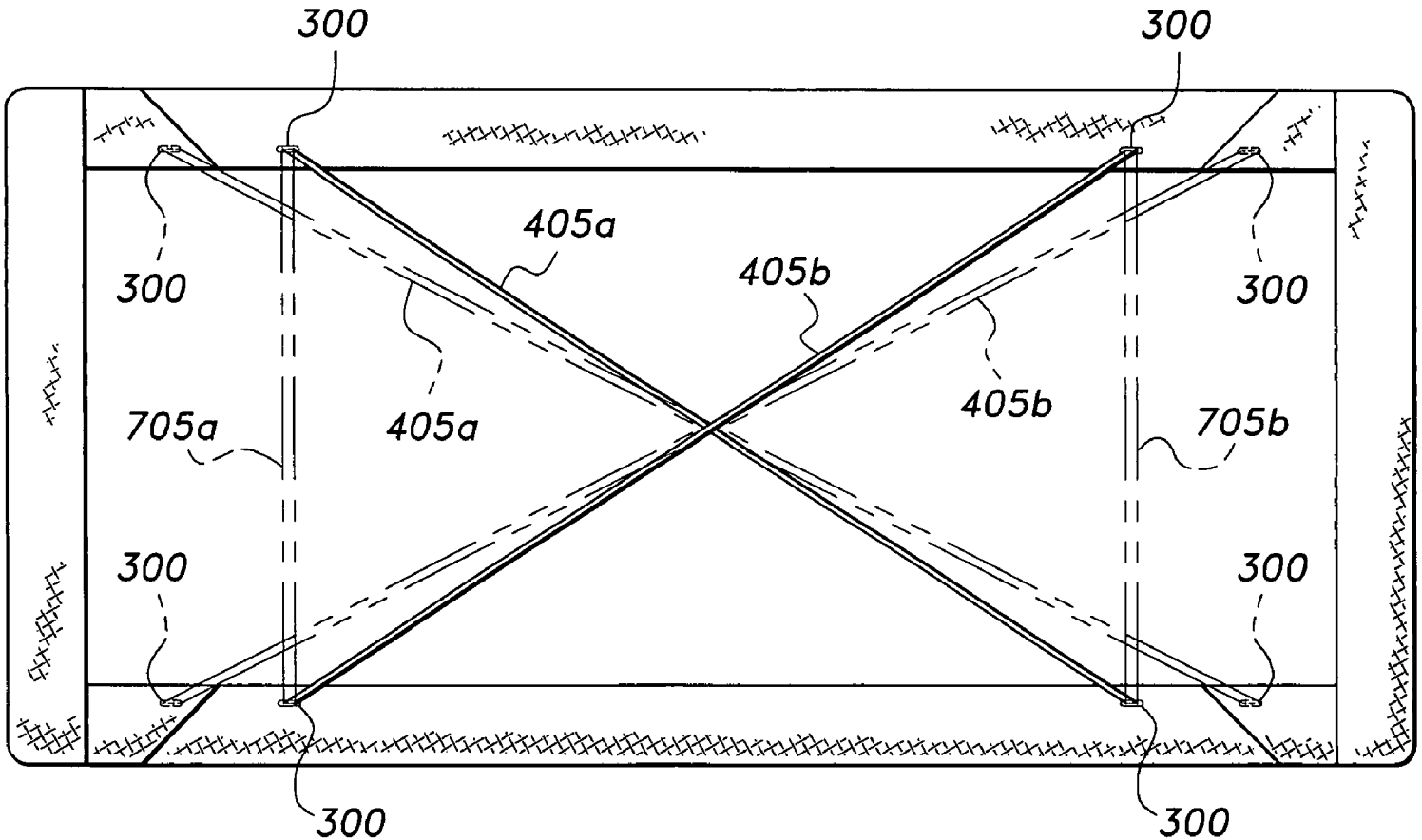
FIG. 7 is a bottom plan view of the fitted sheet system, according to the present invention.

The fitted sheet system 10 makes it easy for shipboard users to easily make a neat, orderly bed that is typically difficult to do in close quarters or when the mattress is accessible from only one aspect of the bunk. As shown in FIG. 7, straps can be provided to pull the sheets into a tighter aspect for a more "shipshape" appearance, and these are applied through slits 300 sewn into the raw edges of the sheet on the underside, and then drawn tight. A diagonally cross-strapped configuration can be formed via straps 405*a* and 405*b*. Alternatively parallel straps 705*a* and 705*b* may be provided. The fitted sheet system 10 makes it easy for people with disabilities to make a bed even when only one hand is used, i.e., when a person is missing one arm, when one arm is in a cast, or even for a parent who is holding a child in one arm.

Figure 8:
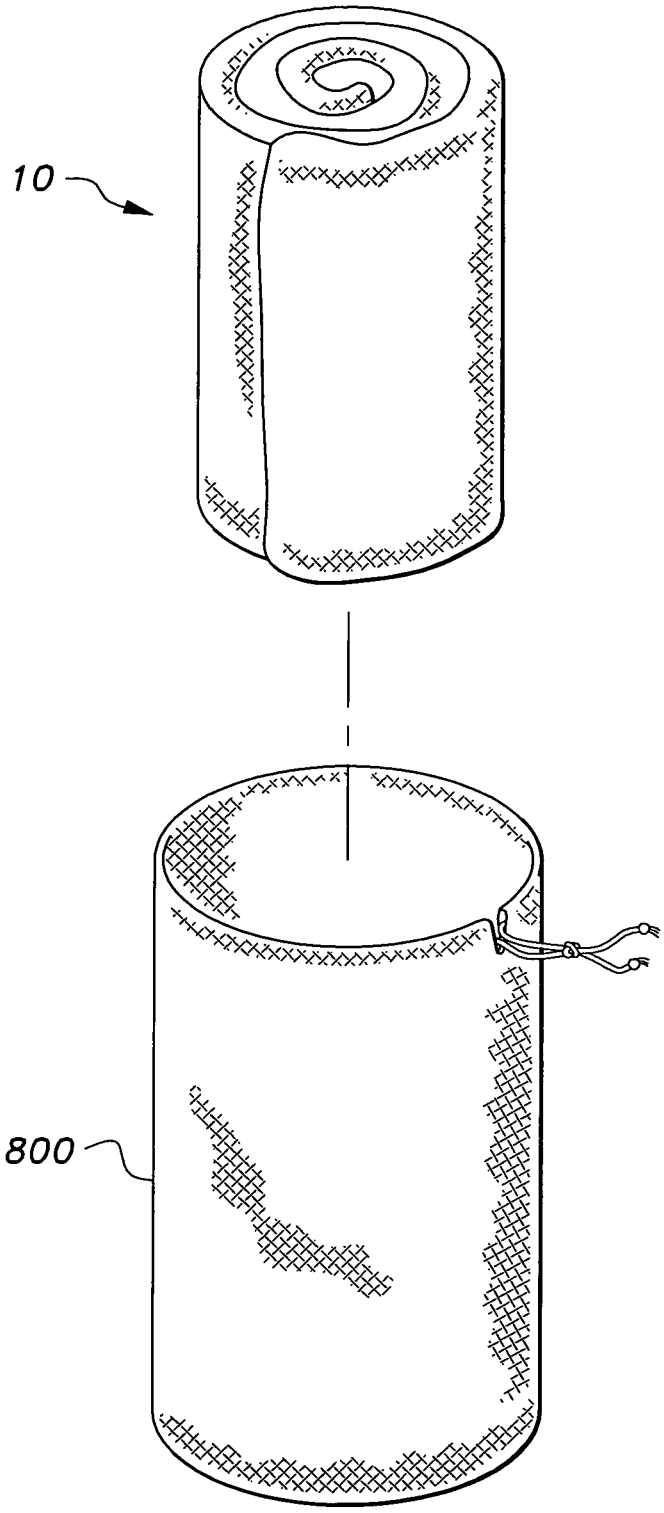
FIG. 8 is a perspective view of the fitted sheet system and a carrying bag, according to the present invention.

As shown in FIG. 8, the fitted sheet system 10 can be packaged in a short duffel-style bag 800 that includes the sheet system 10 and one pillowcase P. The bags 800 are preferably made of cotton with a heavy drawstring so the bags 800 can be easily stowed when not in use, or can be utilized for stowing dirty clothes or other items.

Available sizes include but are not limited to the sizes in Table 1 infra.

TABLE I

| VESSEL | PERSONNEL SERVED | TYPE | SIZE | DIMENSION | MATTRESS NSN | TICKING NSN | MATTRESS COVER NSN |
|---|---|---|---|---|---|---|---|
| Surface Ship | Crew | I | 1 | 72½ × 26 × 3 | 7210-00- | 7210-00- | 7210-00- |
| | | | 2 | 76 × 26 × 3 | 290-8297 | 140-4231 | 883-8492 |
| | | | 3 | 80 × 26 × 3 | 052-7327 | 140-4236 | 082-2081 |
| Surface Ship | CPO | II | 1 | 76 × 28 × 4 | 290-8298 | 140-4234 | 230-1041 |
| | | | 2 | 80 × 28 × 4 | | | |
| Surface Ship | Officers Hospital Berth | III | 1 | 76 × 28 × 6 | 290-8299 | 140-4233 | 883-8492 |
| | | | 2 | 76 × 34¾ × 6 | 290-8300 | 140-4235 | 682-6603 |
| Submarines | Crew | IV | 1 | 73 × 24 × 4½ | 275-5873 | 543-6002 | 244-8842 |
| | | | 2 | 76 × 24 × 4½ | 889-3733 | 543-4231 | 241-9718 |
| Submarines | Officer & CPO | V | | 76 × 26 × 4½ | 275-5874 | 546-6001 | 241-9718 |
| Submarines | CO | | | 76 × 32 × 6 | | 140-4235 | 682-6603 |

It is to be understood that the present invention is not limited to the embodiments described above, but encompasses any and all embodiments within the scope of the following claims.

I claim:

1. A fitted sheet system, comprising:

a bottom sheet having right and left top corners, right, and left bottom corners, a pair of laterally extending edges defining a laterally extending head area and a laterally extending bottom foot area, and a pair of longitudinally extending edges;

at least one cinching member connected to a bottom portion of the bottom sheet, the cinching member tightening the bottom sheet against a mattress when the sheet is disposed on the mattress;

a vertical stitch line disposed at a predetermined position inward from a respective corner;

excess material at the sheet corner being folded inward against the vertical stitch line, a portion of the excess sheet material being sewn to the stitch line, the sewn excess material to the vertical stitch line forming a right triangular shaped edge, hypotenuse of the right triangular shaped edge extending away from the vertical stitch line;

the right triangular shaped edge being outwardly folded back across the vertical stitch line, wherein the hypotenuse edge is in a configuration that abuts sheet material along a side of the sheet as the hypotenuse edge extends inwardly intersecting the vertical stitch line, the hypotenuse edge material being sewn to the abutting side sheet material, wherein a hospital styled pocket is formed, the hospital styled pocket being adapted to receive a corresponding corner of a mattress onto which said bottom sheet is fittable; and a top sheet having a top lateral edge, a bottom lateral edge, a bunk-side longitudinal edge, an open longitudinal edge, the open longitudinal edge opposing the bunk-side longitudinal edge, the bunk-side longitudinal edge being sewn to a corresponding longitudinal edge of the bottom sheet, wherein the stitching extends from the bottom lateral area to a position adjacent the head area thereby defining an open foot area and an open head area, wherein the top sheet is sewn to the bottom sheet at a location parallel to the sewing at the longitudinal edges of the two sheets, thereby creating a pocket between the two sheets, the pocket being used to store a pillow case; and wherein a bottom sheet and top sheet in combination can be easily and neatly disposed on a bunk bed styled mattress.

2. The fitted sheet system according to claim 1, wherein the cinching member comprises at least one strap attached to laterally opposing bottom edges of the sheets, the at least one strap cinching up the sheets against a mattress.

3. The fitted sheet system according to claim 2, wherein the at least one strap comprises a pair of straps substantially parallel to each other.

4. The fitted sheet system according to claim 2, wherein the at least one strap comprises a pair of straps diagonally crossing each other.

5. The fitted sheet system according to claim 1, further comprising:

a pillow case; and a fastening system disposed on the bottom sheet and the pillowcase, the fastening system removably fastening the pillowcase to the sheet.

6. The fitted sheet system according to claim 1, further comprising a decorative hem disposed laterally across an upper portion of the upper sheet.

7. The fitted sheet system according to claim 1, further comprising decorative embroidery proximate the decorative hem.

8. The fitted sheet system according to claim 1, further comprising a duffel bag, the duffel bag being adapted for receiving the fitted sheet system for storage and transport.

9. A fitted sheet system, comprising: a horizontal bottom sheet having right and left top corners, right, and left bottom corners, a pair of laterally extending edges defining a laterally extending head area and a laterally extending bottom foot area, and a pair of longitudinally extending edges that extend vertically downward from the bottom sheet; at least one cinching member connected to a bottom portion of the bottom sheet, the cinching member tightening the bottom sheet against a mattress when the sheet is disposed on the mattress; and a top sheet having a top lateral edge, a bottom lateral edge, a bunk-side longitudinal edge, an open longitudinal edge, the open longitudinal edge opposing the bunk-side longitudinal edge, the bunk-side longitudinal edge being sewn to a corresponding longitudinal edge of the bottom sheet, wherein the stitching extends from the bottom lateral area to a position adjacent the head area thereby defining an open foot area and an open head area, said top sheet further including an additional stitching sewn to the bottom sheet at a location parallel to the sewing at the longitudinal edges of the two sheets, thereby creating a pocket between the two sheets, the pocket being used to store a pillow case.

* * * * *